United States Patent [19]

Ishii et al.

[11] Patent Number: 4,951,093

[45] Date of Patent: Aug. 21, 1990

[54] DEVELOPING UNIT FOR AN ELECTROSTATIC RECORDING APPARATUS

[75] Inventors: Kohji Ishii; Hiroyuki Honda; Kazuyuki Tanaka; Noboru Koizumi, all of Hachioji, Japan

[73] Assignee: Konica Corporation, Tokyo, Japan

[21] Appl. No.: 280,638

[22] Filed: Dec. 6, 1988

[30] Foreign Application Priority Data

| | | | |
|---|---|---|---|
| Dec. 18, 1987 | [JP] | Japan | 62-320714 |
| Dec. 18, 1987 | [JP] | Japan | 62-320716 |
| Mar. 25, 1988 | [JP] | Japan | 63-71262 |
| Mar. 25, 1988 | [JP] | Japan | 63-71263 |

[51] Int. Cl.[5] ..... G03G 15/08

[52] U.S. Cl. ..... 355/245; 355/211; 355/260; 355/269; 355/296; 355/299

[58] Field of Search ..... 355/245, 210, 211, 260, 355/269, 296, 299

[56] References Cited

U.S. PATENT DOCUMENTS

| | | | |
|---|---|---|---|
| 4,183,658 | 1/1980 | Winthaegen | 355/212 |
| 4,271,786 | 6/1981 | Buckley et al. | 355/245 X |
| 4,325,626 | 4/1982 | Murata et al. | 355/211 |
| 4,339,196 | 7/1982 | Beck et al. | 355/245 X |
| 4,615,605 | 10/1986 | Kida et al. | 355/245 X |
| 4,621,919 | 11/1986 | Nitanda et al. | 355/211 |
| 4,674,858 | 6/1987 | Nagayama | 355/211 |
| 4,746,951 | 5/1988 | Hayakawa et al. | 355/245 |

*Primary Examiner*—A. C. Prescott

*Attorney, Agent, or Firm*—Jordan B. Bierman

[57] ABSTRACT

Disclosed is a developing unit equipped with a shaft supporting mechanism for slidably supporting a photosensitive drum, thereby the photosensitive drum can be pressed onto the developing sleeve with an elastic force. The unit has a balancing mechanism for eliminating a thrust force caused by the driving mechanism.

11 Claims, 8 Drawing Sheets

DEVELOPING UNIT FOR AN ELECTROSTATIC RECORDING APPARATUS

BACKGROUND OF THE INVENTION

This invention relates to a developing unit for an electrostatic recording apparatus such as an electrophotographic copying apparatus.

An electrostatic recording apparatus such as an electrophotographic copying apparatus usually uses a rotary drum type photosensitive member having, as its outer circumferential face, a photoconductive layer. Such an electrostatic recording apparatus obtains desired records by charging the photosensitive member, exposing an image to form an electrostatic latent image of an original image on the above mentioned photorecepting layer while rotating the photosensitive member, developing the image with toner, and transferring the image onto a recording paper.

In the developing unit used for electrostatic recording apparatus such as an electrophotographic copying apparatus, a developing sleeve 3 which is provided with a built-in fixing magnet faces photosensitive drum 1 in a housing 2 which faces such a photosensitive drum, as shown in FIG. 12. While transferring the developer which is mixed in the housing 2 onto the peripheral surface of the developing sleeve 3, toner particles which are contained in the developer are electrostatically absorbed on the electrostatic image which is formed on the surface of the photosensitive drum 1.

In other words, the electrostatic image is made into a visible image by the toner. The distance d between this developing sleeve 3 and the photosensitive drum has been kept constant. If the distance d is not uniform, generated electric field becomes uneven, which adversely affects developability. Therefore, a roller 4 which is processed to the size equivalent to the distance d has been provided on the developing sleeve 3 at the end of the axis of the developing sleeve 3.

The housing 2 has been pressed toward the photosensitive drum 1 in the direction shown with an arrow mark by a means such as spring (not shown in the figure) so that the roller 4 is in contact with the surface of the photosensitive drum 1.

In the case of the above developing unit, however, precision of processing of the roller is required. Since the roller 4 rotates while being always in contact with the photosensitive drum 1, the surface of the drum tends to be damaged.

Recently a unit of entire image formation section including a photosensitive drum and a developing unit has been developed. The unit is replaced for each color to make color copies easily. On such an unit, a photosensitive drum and an entire developing unit are installed in one housing. However, since a distance d between the surface of the photosensitive drum and the developing sleeve must be secured, it was impossible to press the developing sleeve alone against the photosensitive drum independent from a developer mixing plate, etc.

SUMMARY OF THE INVENTION

This invention has been made to overcome the above mentioned problems. Its object is to provide a developing apparatus of movable photosensitive drum type which can maintain the distance between the photosensitive drum and the developing sleeve without using a roller.

The above objective can be achieved by a developing unit Which is equipped with a shaft supporting member which movably supports the photosensitive drum against the developing sleeve and a pressing member which presses the photosensitive drum onto a layer of developer on the developing sleeve with uniform force s that the distance between the photosensitive drum and the developing sleeve can be kept uniform.

As mentioned above, the inventors found out that the distance between the photosensitive drum and the developing sleeve can be maintained without using a roller if the photosensitive drum is movably supported by shaft against the developing sleeve and the photosensitive drum is pressed on the developer on the developing sleeve with a uniform force.

However, if the force which presses the photosensitive drum on the developer on the developing sleeve is too large, carrier of the developer may damage the surface of the photosensitive drum. If the force is too small, the distance cannot be kept uniform.

In order to provide a developing unit of movable photosensitive drum type which can press the photosensitive drum on the developer on the developing sleeve with a most appropriate amount of force, a photosensitive drum is movably supported by shaft on the side of the developing sleeve and the photosensitive drum is pressed on a developer on the developing sleeve with a force of 5 to 150 g/cm.

DETAILED DESCRIPTION OF THE INVENTION

An embodiment of this invention will be explained based on the attached drawings.

Figure 1:
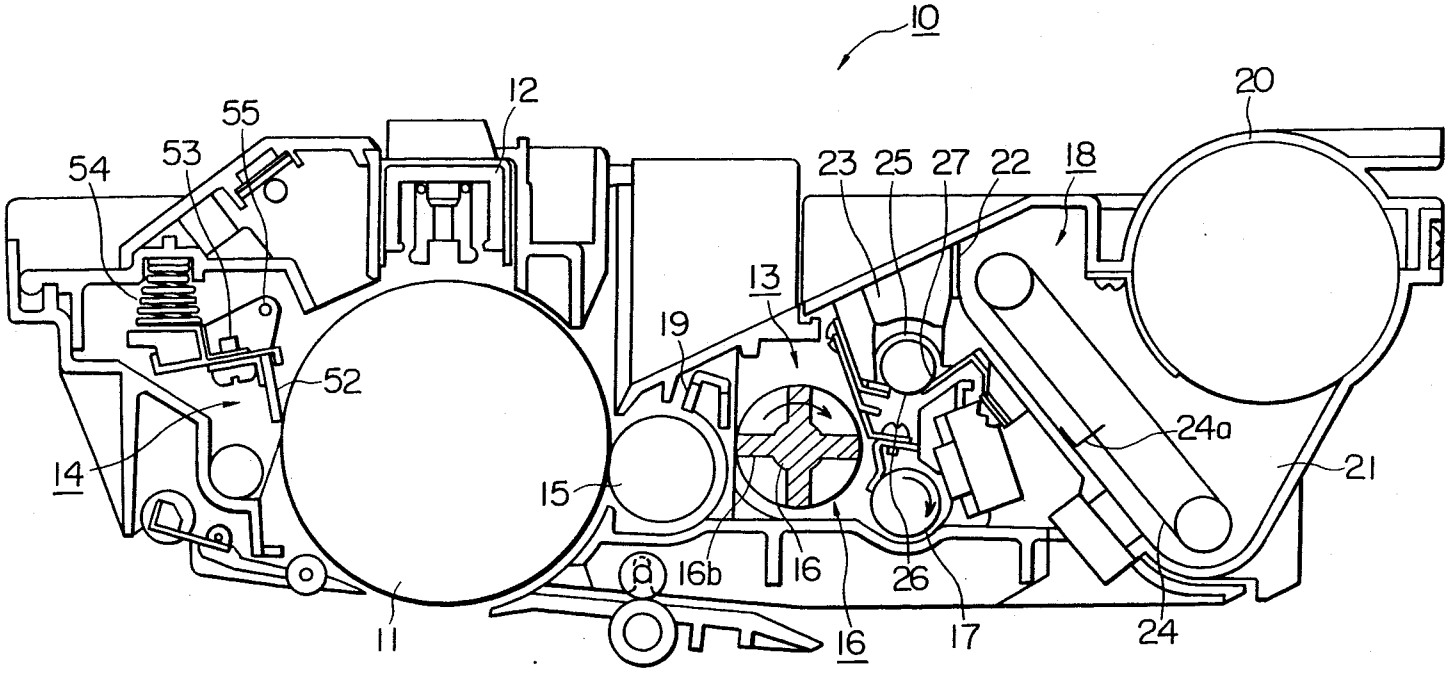
FIG. 1 is a structural view of an image formation unit of a copying machine equipped with a developing unit according to this invention.

In FIG. 1, numeral 10 represents an image formation unit of a copying machine. Within this image formation unit 10, a charging section 12, a developing section 13, and a cleaning section 14 are arranged around a photosensitive drum 11. A transfer section is located under the photosensitive drum 11 and is not provided with this unit.

The developing section 13 is equipped with a developing sleeve 15, a main mixing plate 16, and an auxiliary mixing plate 17. The developing sleeve 15 is installed adjacent to the photosensitive drum 11 to electrostatically absorb toner particles in a developer on the surface of the drum and develop an electrostatic latent image to be a toner image. The main mixing plate 16 is diagonally fixed with respect to a rotary shaft **16*a* (not shown in the figure) to mix the developer (carrier and toner) and scrape the developer with a plate 16*b* installed between each mixing plate 16 in the direction of rotation (arrow mark). The auxiliary mixing plate 17 mixes toner supplied from a toner supplying section 18 with developer which circulates within the developing section 13 and feed them to the section where the main mixing plate 16 is installed. The numeral 19 represents a developer control blade fixed to the image formation unit. It is used to control the thickness of the developer layer D which is attached on the surface of the developing sleeve 15**.

The toner supplying section 18 is equipped with a toner storage chamber 21 for which a cartridge 20 can be replaced and a toner supplying chamber 23 which is connected to the toner storage chamber via an opening 22 on the upper part of the storage chamber 21. In the toner storage chamber 21, a ladder chain is provided to scrape up toner particles in the storage chamber 21 with a toner transfer plate **24*a* and transfer them into the toner supplying chamber 23 via the opening 22. The toner supplying chamber 23 is equipped with a supplying roller 25 which rotates to supply toner particles into the developing section between a tanggue 29 of the opening groove 26** provided under the supplying chamber.

Figure 3:
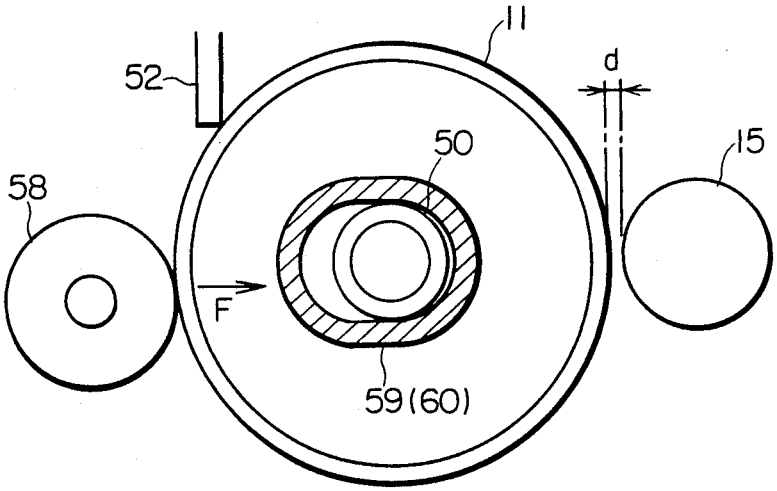
FIG. 3 is a plan section which shows the photosensitive drum supported by shaft.
Figure 4:
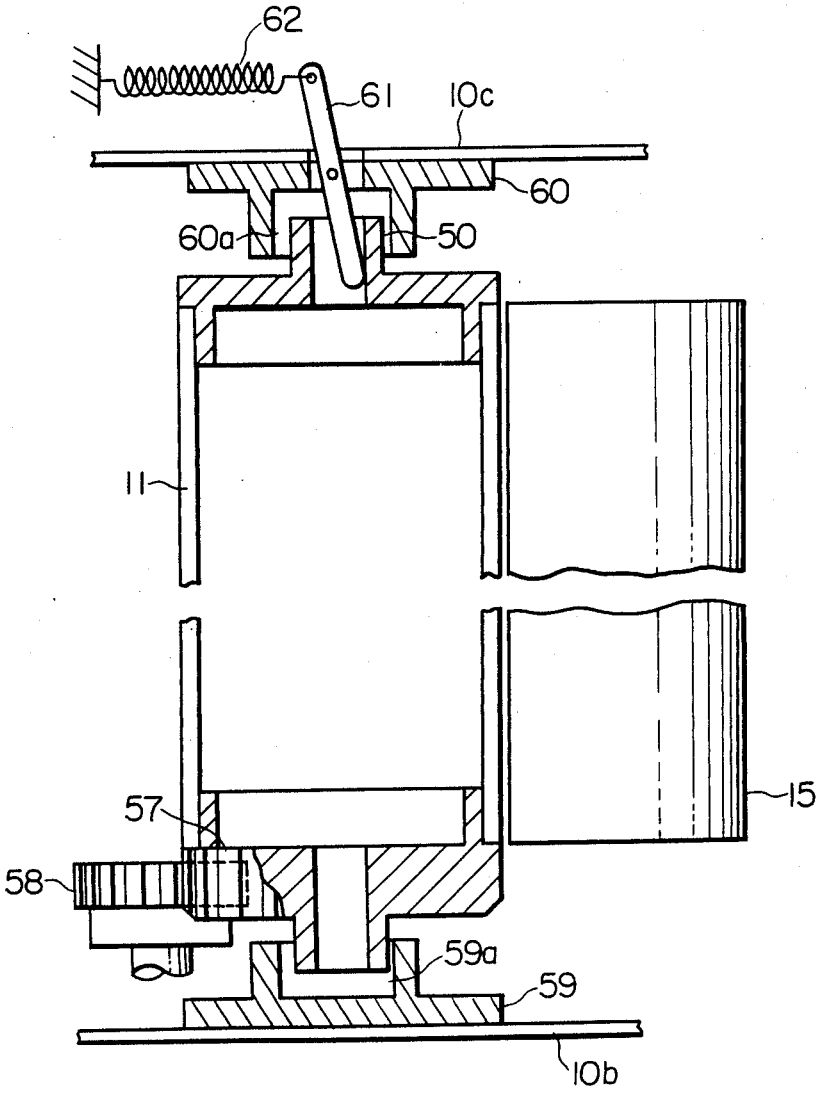
FIG. 4 is a side view of a embodiment 1 of this invention.

In this invention, shaft supporting members 59 and 60 with a horizontally long hole as shown in FIG. 3 are provided. The shaft of the above mentioned photosensitive drum 11, which protrudes at the both ends of the photosensitive drum, is movably supported by the shaft supporting members 59 and 60. As shown in FIGS. 3 and 4, the photosensitive drum 11 is movably supported on the side of the developing sleeve 15 by the shaft supporting members 59 and 60, having horizontally long holes **59*a* and 60*a*, fixed to the side plates 10*b* and 10*c* located on both sides of the image formation unit 10** via a bearing member (not shown in the figure) such as a bearing.

Figure 2:
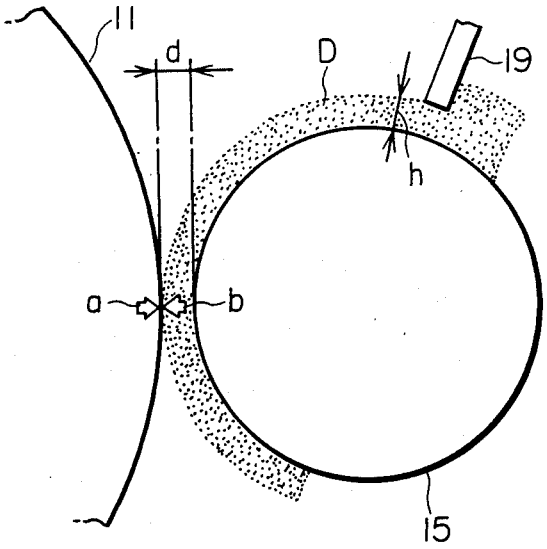
FIG. 2 is an explanatory drawing which shows the relationship between the limit of thickness of developer layer on the developing sleeve.

Thus the photosensitive drum 11 is pressed on the developer layer D in the direction shown with the arrow mark in FIG. 2. The pressing force is desirably in the range of 5 to 150 g/cm. If the force is less than 5 g/cm, such a weak force cannot maintain the distance between the photosensitive drum 11 and the developing sleeve 15. If the force exceeds 150 g/cm, the force is too large and may damage the surface of the photosensitive drum with carrier in the developer.

Such a pressing force is desirably applied by a cleaning blade 52 of the cleaning section 14.

The cleaning blade 52 is supported at the front end of the supporting member 53. Its rear end is pushed by a spring 54 and the blade rotates counterclockwise on a hinge connection section 55. With this rotary force, the blade contacts the Surface of the photosensitive drum. Utilization of this rotary force eliminates loss of the force and prevent the contacting force of the cleaning blade 52 from weakening even if the photosensitive drum 11 escapes to the developing sleeve side 15.

The developer which forms the developer layer D is a two-component developer consisting of carrier and toner. The carrier of the developer generates a resiliency shown with an arrow mark b as shown in FIG. 2. Accordingly, as long as the thickness h of the developer layer D on the developing sleeve 15 is kept uniform by the regulating plate 19, the distance d between the developing sleeve 15 and the photosensitive drum 11 can be maintained close to the thickness h (0.3–0.5 mm).

Since the maximum movable range of the long hole of the photosensitive drum 11 in the direction of long diameter is approximately 0.4 mm and within the range of focal depth of lenses optically used, image formation of the original data will not be hindered. If rotary drive force for rotating the photosensitive drum 11 is transmitted from the drive gear 58 to the drum gear or idler gear 57 which is formed on the outer peripheral of one end of the drum as shown in FIGS. 3 through 6, the rotary drive force causes the drum gear 57 of the photosensitive drum to separate from the drive gear 58 in the motion of engaging rotation between the drive gear 58 on the unit body and the drum gear 57 on the photosensitive drum, accordingly, "separating force" causes to tilt the left or right side of the photosensitive drum 11.

Accordingly, a pressing member which presses the photosensitive drum 11 is provided with this invention. This pressing member presses one of the ends of the shaft of the photosensitive drum 11 and eliminates the action of the "separating force".

In the embodiment shown in FIG. 4, a pressing member is provided at the shaft supporting section on which the drum gear 57 is nor provided and equivalent amount of force is generated against the "separating force" so that the "seperating force" is cancelled.

Figure 5:
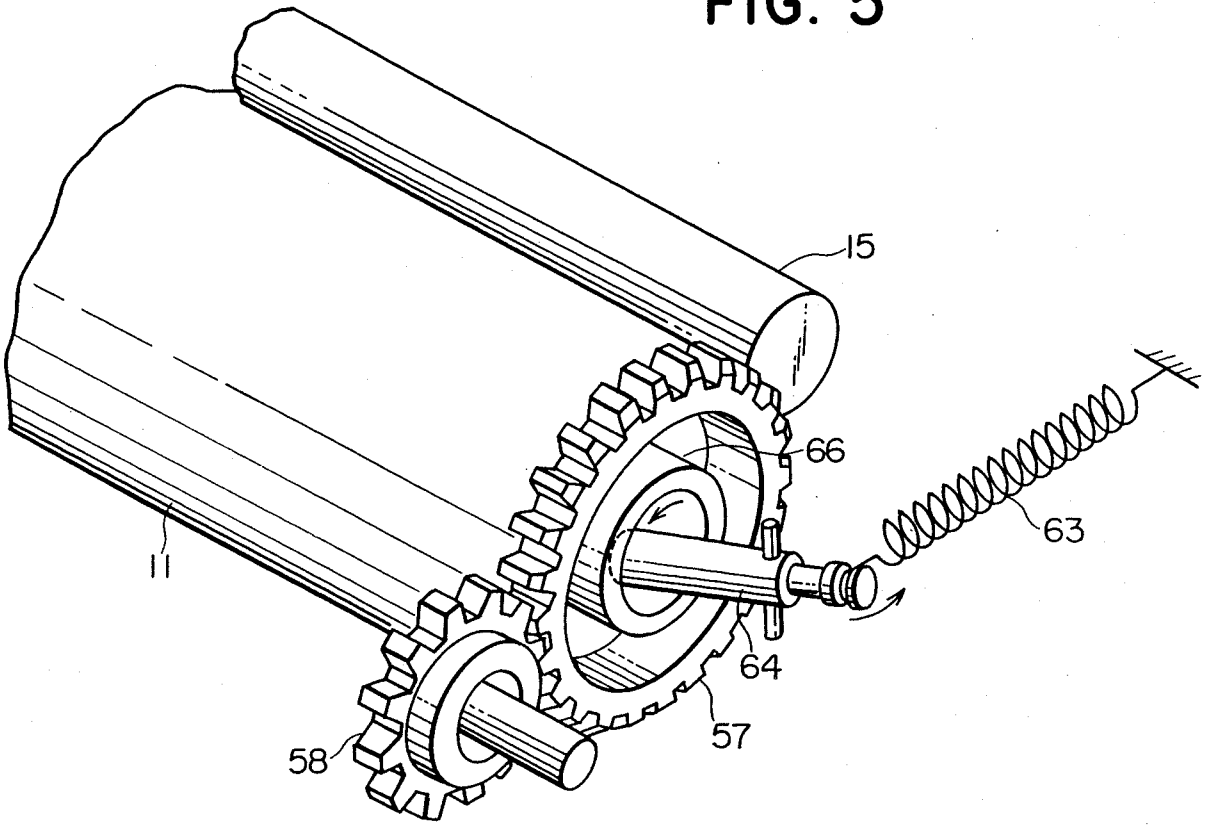
FIG. 5 is a perspective view of an embodiment 2 of this invention.
Figure 6:
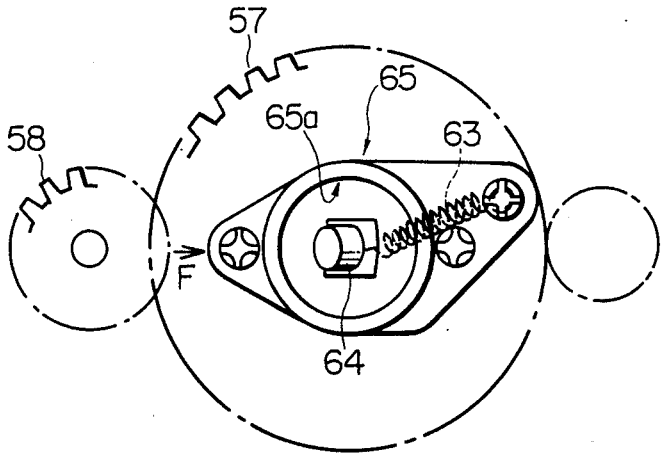
FIG. 6 is a plan view of the shaft supporting section of the above embodiment viewed from the photosensitive drum side.
Figure 7:
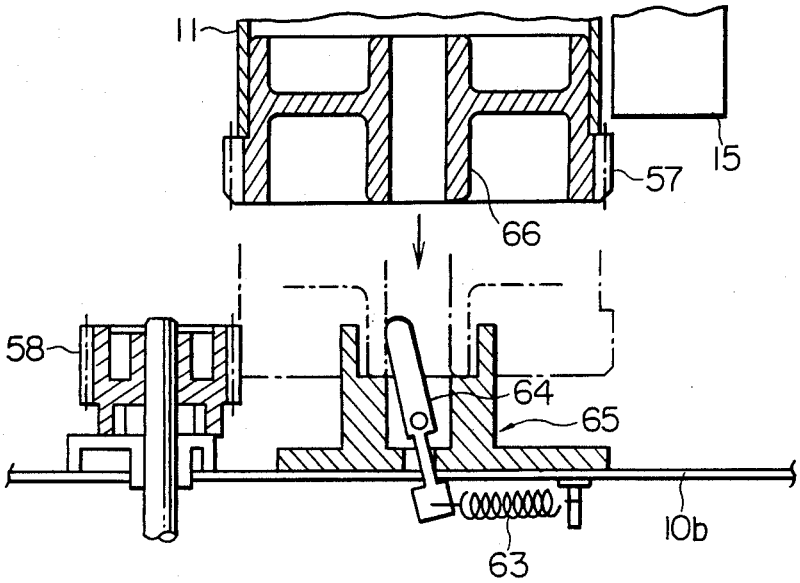
FIG. 7 is a side section of the above shaft supporting section.

FIG. 5 is a perspective view of the transfer section of the rotary driving force to the photosensitive force. FIG. 6 is a plan view of the pressing member mounting section viewed from the drum side (inside). FIG. 7 is a cross section of the pressing member mounting section. In these drawings, the same numerals are used for the members which are equivalent to those in the embodiment 1.

In this embodiment 2, a shaft supporting member 65 with a horizontally long hole **65*a* is also provided. The shaft of the above mentioned photosensitive drum 11, which protrudes at the end of the photosensitive drum, is movably supported by the shaft supporting member 65. As shown in FIG. 7, the photosensitive drum 11 is movably supported on the side of the developing sleeve 15 by the shaft supporting member 65, having a horizontally long hole 65*a*, fixed to the side plate 10*b* of the image formation unit 10**.

A pressing pin 64 and a pulling spring 63 are provided for the shaft supporting member 65 at the side the photosensitive drum 11 is equipped with a drum gear 57, applying a force equivalent to the "separating force F" in the opposite direction to cancel the influence of such a force.

Although a cleaning blade has been used as a member to provide pressing force in the above embodiments, this invention is not limited to them.

Other embodiments are explained as below.

Figure 8:
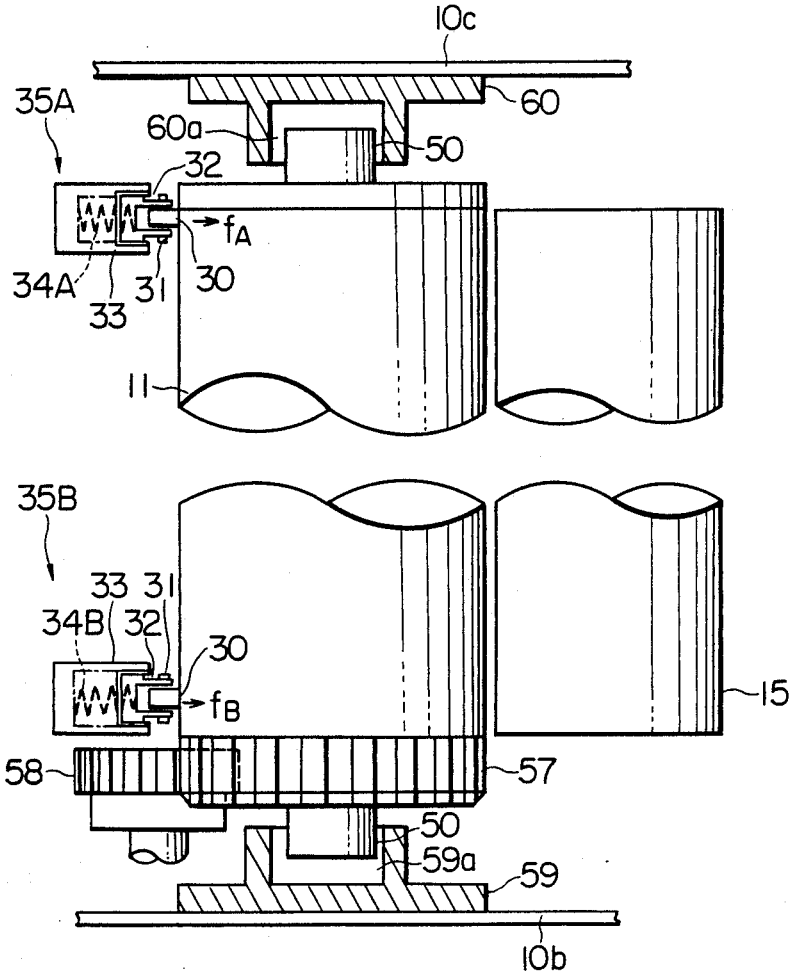
FIG. 8 is a plan view of an embodiment 3 of his invention.
Figure 9:
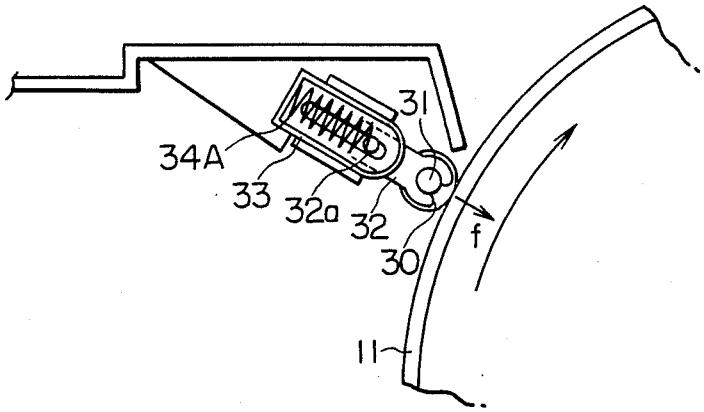
FIG. 9 is a side view of the above embodiment 3.

FIG. 8 is a plan view of an embodiment 3 in which a follower roller which presses the photosensitive drum 11 from behind toward the developing sleeve. FIG. 9 is a side view of the above follower roller.

In these drawings, the follower roller 35 comprises a roller 30, a roller shaft 31, a roller shaft member 32, a stopper pin 32*a*, a supporting frame 33, coil springs 34A and 34B, etc.

The roller is rotatably supported by a roller shaft 31 on the roller support member 32. The roller support member 32 is movably hold in the longitudinal direction by the supporting frame 33. The supporting frame 33 has a slit type guide hole 33*a* in the longitudinal direction. The stopper pin 32*a* of the roller supporting member 32 fits in this hole 33*a*. One end of the coil spring 34A is connected to the stopper pin and the other to the supporting frame 33, which facilitates mounting and dismounting. The roller 30 is forced toward the arrow mark f by the coil spring 34 and presses the photosensitive drum 11.

In this embodiment, pressing force of each follower roller is varied by selecting a coil spring of different spring constant.

If a rotary drive of the photosensitive drum 11 is obtained from a drive gear 58 to the drum gear which is formed on the outer peripheral of one end of the drum, a rotary driving force is transferred from the drive side to the driven side at the engaged section along with the rotation made by the engagement of the drive gear 58 of the unit side and the drum gear 57 on the side of the photosensitive drum. As shown in the above mentioned embodiment 3, when this rotary driving force is transferred to the drum gear 57 on the driven side, this force acts as a resultant force of a component in the direction which rotates the drum gear 57 and a component in the direction which separates the drum gear 57 from the drive gear 58. The both ends of the photosensitive drum 11 tend to tilt because of a component which causes the side of the drum gear 57 to separate from the drive gear 58, that is, a separating force F.

Therefore, follower rollers 35A and 35B are provided in the embodiment of this invention to press the photosensitive drum from behind. These follower rollers 35A and 35B press left and right ends of the photosensitive drum 11 with different pressing force and cancel the action of the separating force F.

In the embodiment 3 shown in FIG. 8, a pressing force fA is applied to the shaft end where the drum gear 57 is not provided and fB to the shaft end where the drum gear 57 is provided so that the addition of the separating force F and the pressing force fB will equal to the pressing force fA and cancel the action of the separating force F.

Figure 10:
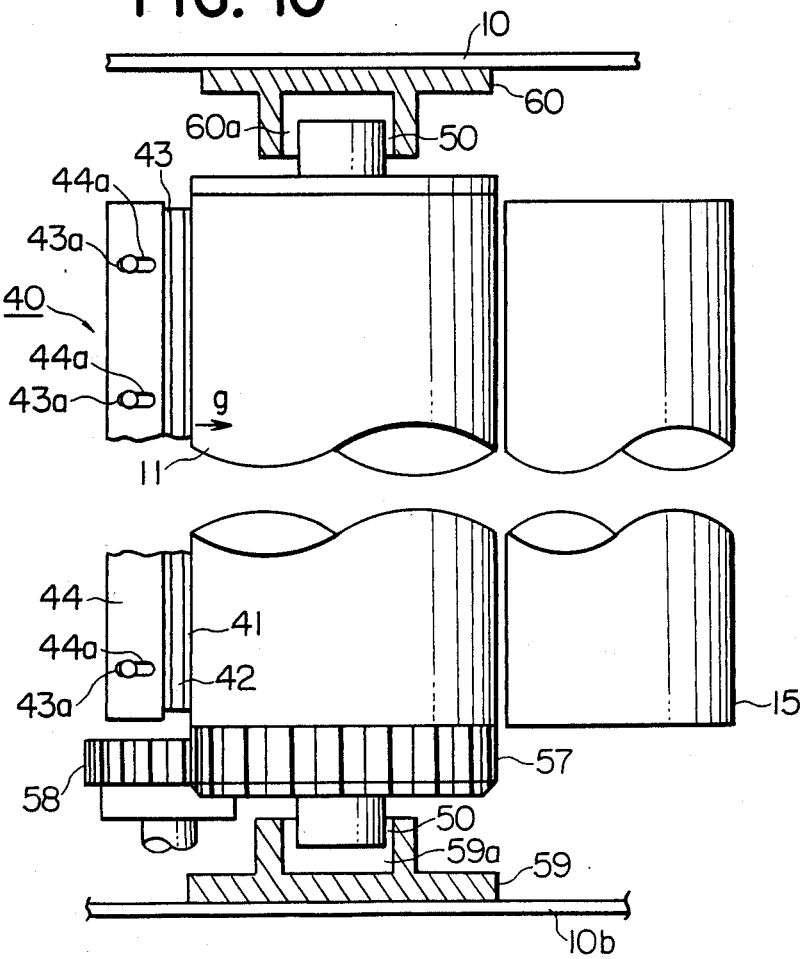
FIG. 10 is a plan view of an embodiment 4 of this invention.
Figure 11:
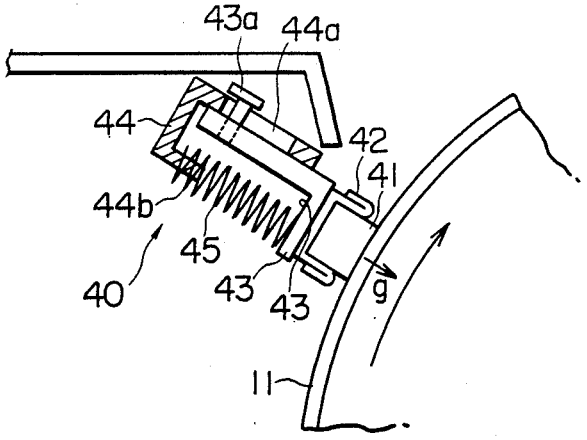
FIG. 11 is a side view of the above embodiment 4.
Figure 12:
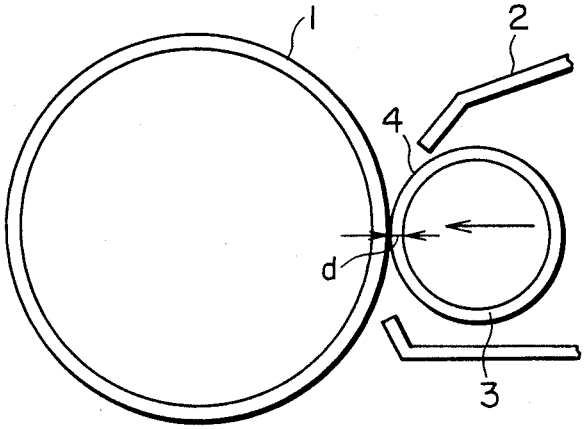
FIG. 12 is an explanatory drawing of the conventional unit.

FIG. 10 is a plan view of the embodiment 4 in which the photosensitive drum 11 is pressed by a grinding member 40 from behind. FIG. 11 is a side view of the grinding member 40.

In these drawings, the grinding member 40 which contacts the surface of the photosensitive drum 11 to slightly grinds its surface is composed of a grinding pad 41, a pad holder 42, a slide plate 43, a slide pin 43*a*, a slide plate guide frame 44, a pressing spring 45, etc.

The grinding pad 41 is supported by the pad holder 42. The pad holder 42 is fixed on the slide plate 43. The slide plate guide frame 44 has a plural number of slit type slide holes 44 which are movable toward the surface of the photosensitive drum 11. The slide pin 43*a* of the slide plate 43 fits in this slide hole 44*a*. On end of the pressing spring 45 is engaged to the engaging surface of the slide plate 43, while the other end is engaged to the engaging section 44*b* of the slide plate guide frame 44, thus facilitating mounting and dismounting. The grinding member 40 is moved in the direction of an arrow g by the pressing spring 45 to press the photosensitive drum 11.

Although this invention has been explained with embodiments using two-component developer, it can be also used with one-component developer.

Variation of the above mentioned embodiments based on the technical concept of this invention is, of course, possible.

Since this invention features a photosensitive drum which is movably supported on the side of the developing sleeve and pressed onto a developer on the developing sleeve with uniform and constant force, a knocking roller to maintain the distance of the photosensitive drum and the developing sleeve is not necessary. In addition, processing for the purpose of increasing precision of the roller is not necessary, thus realizing lower production cost. Since damages on the surface of the photosensitive drum caused by the roller can be prevented, longer drum life can be obtained.

Since this invention makes it possible to maintain the distance between the photosensitive drum and the developing sleeve by the movement of the photosensitive drum, adjustment Can be easily made when the photosensitive drum and the developing sleeve are installed in the same unit, resulting in various advantages such as simpler structure of the entire image formation unit.

The photosensitive drum of this invention is movably supported by shaft at the side of the developing sleeve and the drum is pressed on the developer on the developing sleeve with a force of 5 to 150 g/cm. Therefore, an amount of force applied to press the photosensitive drum on the developer on the developing sleeve will not be too large or too small and a developing apparatus of movable photosensitive type in which the photosensitive drum is pressed on the developer on the developing sleeve with optimum amount of force can be produced.

What is claimed is:

1. An image forming apparatus comprising an image forming means being rotatable around an axis thereof and having an image surface for forming a latent image thereon;

a developing means having a developer surface for carrying a developer layer thereon, said developer surface facing toward said image surface so that the developer layer comes in contact with the image surface, thereby developing the latent image to become visible;

a support means for supporting the axis of said image forming means so that the image surface is movable in the direction to the developer surface; and a pressing means for pressing said image forming means so that the image surface presses the developer layer onto the developer surface.

2. The apparatus of claim 1, wherein said image forming means and said developing means are constituted to form one unit.

3. The apparatus of claim 1, wherein said pressing means is a cleaning means being pressed onto said image forming means for removing a developer from the image surface.

4. The apparatus of claim 3, wherein said pressing means comprises a cleaning blade contacting the image surface and an elastic member for pressing the cleaning blade onto the image surface.

5. The apparatus of claim 1, wherein said pressing means is a polishing means being pressed onto said image forming means for polishing the image surface.

6. The apparatus of claim 1, wherein said pressing means comprises a roller being pressed onto the image forming means so that the roller is rotated by the rotation of said image forming means.

7. The apparatus of claim 1, wherein said pressing means is adapted to exert pressing force of 5–150 g/cm on said image forming means.

8. The apparatus of claim 1, wherein said image forming means has an idle gear at one side of the axis thereof and a driving gear transmits a driving force through said idle gear so as to rotate said image forming means, and wherein said pressing force has a balancing mechanism for eliminating a thrust force caused by the driving force so that a motion of said idle gear is prevented from moving away from the driving gear.

9. The apparatus of claim 8, wherein said balancing mechanism is positioned at the side located the idle gear.

10. The apparatus of claim 8, wherein said balancing mechanism comprises a spring member and a pin member adapted to engage with a side of axis of said image forming means.

11. The apparatus of claim 1, wherein the developer comprises a carrier and a toner.

* * * * *